US010344517B2

(12) United States Patent
McGregor et al.

(10) Patent No.: US 10,344,517 B2
(45) Date of Patent: Jul. 9, 2019

(54) SOFT CLOSE DEVICE FOR COMPACT HINGES

(71) Applicant: Hardware Resources, Inc., Bossier City, LA (US)

(72) Inventors: Dennis McGregor, Farmers Branch, TX (US); Travis McElveen, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 180 days.

(21) Appl. No.: 15/294,184

(22) Filed: Oct. 14, 2016

(65) Prior Publication Data

US 2017/0107749 A1 Apr. 20, 2017

Related U.S. Application Data

(60) Provisional application No. 62/242,042, filed on Oct. 15, 2015, provisional application No. 62/242,052, filed on Oct. 15, 2015.

(51) Int. Cl.
*E05F 3/20* (2006.01)
*E05F 5/00* (2017.01)

(52) U.S. Cl.
CPC ..... *E05F 3/20* (2013.01); *E05F 5/006* (2013.01)

(58) Field of Classification Search
CPC ..... E05F 3/20; E05F 5/006; E05Y 2900/20; E05Y 2201/21; E05Y 2201/264
See application file for complete search history.

(56) References Cited

U.S. PATENT DOCUMENTS 5,761,766 A * 6/1998 Basham ..... E05F 5/06 16/85
7,127,778 B2 10/2006 Salice
(Continued)

FOREIGN PATENT DOCUMENTS

CN 203308270 11/2013
CN 102268948 11/2014
(Continued)

OTHER PUBLICATIONS

"TEC Soft-close," TEC, grassusa.com, Jan. 22, 2016. http://web.archive.org/web/20160122034958/http://www.grassusa.com/products/tec-softclose/.

(Continued)

*Primary Examiner* — Victor D Batson
*Assistant Examiner* — Matthew J Sullivan
(74) *Attorney, Agent, or Firm* — Schultz & Associates, P.C.

(57) ABSTRACT

Disclosed is a soft-close device for a compact hinge comprising a housing removably fitted to the compact hinge and a plunger slidingly engaged with the housing. The housing includes a cavity sized and shaped to receive the plunger. The plunger includes a collar that when the plunger is rotated will engage a slot in the housing to deactivate the soft close functionality of the device. In an alternate embodiment, a tab slides around the exterior of the collar to engage the slot. In another alternate embodiment, the plunger includes a detent that engages a catch formed in the housing. The catch extends from a flexible arm of the housing that can be elastically deformed to deactivate and reactivate the soft-close functionality.

8 Claims, 9 Drawing Sheets

(56) References Cited

U.S. PATENT DOCUMENTS

| | | | | |
|---|---|---|---|---|
| 7,395,580 | B2 | 7/2008 | Brustle et al. | |
| 7,730,582 | B2 | 6/2010 | Migli | |
| 8,307,498 | B2 | 11/2012 | Krammer | |
| 8,375,518 | B2 | 2/2013 | Haemmerle | |
| 8,505,165 | B2 | 8/2013 | Domenig et al. | |
| 8,561,262 | B1 * | 10/2013 | Liang | E05F 5/006 16/286 |
| 8,572,810 | B2 | 11/2013 | Brunnmayr | |
| 8,857,014 | B2 | 10/2014 | Brunnmayr | |
| 8,935,829 | B2 | 1/2015 | Oshima et al. | |
| 9,057,214 | B2 | 6/2015 | Salice | |
| 9,115,525 | B2 * | 8/2015 | Zimmer | E05F 5/006 |
| 9,163,447 | B1 | 10/2015 | Liang et al. | |
| 9,169,681 | B2 | 10/2015 | Cooper et al. | |
| 9,366,067 | B2 | 6/2016 | Wu | |
| 9,719,284 | B2 * | 8/2017 | Chen | E05F 5/006 |
| 9,840,864 | B2 * | 12/2017 | Chen | E05F 5/006 |
| 2013/0055528 | A1 | 3/2013 | Lowe | |
| 2013/0239363 | A1 | 9/2013 | Capur | |
| 2017/0107749 | A1 * | 4/2017 | McGregor | E05F 5/006 |
| 2017/0241175 | A1 * | 8/2017 | Hammerer | E05D 3/16 |
| 2018/0100339 | A1 * | 4/2018 | Kirenci | E05F 5/006 |

FOREIGN PATENT DOCUMENTS

| | | | | |
|---|---|---|---|---|
| CN | 104727684 | | 6/2015 | |
| DE | 10227078 | | 1/2004 | |
| DE | 202012003508 | | 7/2013 | |
| EP | 2746509 | | 6/2014 | |
| EP | 2455569 | | 7/2014 | |
| JP | 20140005194 | | 12/2014 | |
| WO | WO-2010114500 | A1 * | 10/2010 | E05F 5/006 |
| WO | 2015078952 | | 6/2015 | |

OTHER PUBLICATIONS

"Blum One Piece Compact Hinges with Built-in Blumotion," Hardware Source, hardwaresource.com, Aug. 13, 2012. http://web.archive.org/web/20120813033852/http://www.hardwaresource.com/hinges/CABINET+HINGES/European+Hinges+-+Blum+Hinges/Blumotion+Soft+Close+for+Cabinets/Blum+One+Piece+Compact+Hinges+with+Builtin+Blumotion.

"Silentia Face Frame Hinge Soft Closing Press In," Salice, saliceamerica.com, Aug. 2016. http://www.saliceamerica.com/en/hinges/face-frame/integrated-soft-close-mechanism/silentia-face-frame_en_0_1_13872_3230.html.

* cited by examiner

SOFT CLOSE DEVICE FOR COMPACT HINGES

CROSS REFERENCE TO RELATED APPLICATIONS

This application claims the benefit of U.S. Provisional Patent Application No. 62/242,042 filed on Oct. 15, 2015 and U.S. Provisional Patent Application No. 62/242,052 filed on Oct. 15, 2015, the contents of which are incorporated herein by reference.

FIELD OF THE DISCLOSURE

The present disclosure relates to soft close devices for compact hinges. In particular, the present disclosure relates to a soft close device having deactivation functionality.

BACKGROUND OF THE DISCLOSURE

In the field of cabinetry and mill work, the typical hinged connection includes a hinge cup mounted to a furniture carcass and pivotally connected to a hinge arm mounted to a door. A metal coil spring biases the metal hinge cup toward the metal hinge arm often in a manner that may damage cabinetry doors and cause unwanted slamming noise. Damped, controlled closure provided by removable, soft close devices prevents damage to cabinetry doors and helps avoid unwanted noise. However, during installation of soft close devices it is often preferable to have the ability to turn off the soft close functionality in order to optimize how many soft close devices are active on each cabinet door.

Prior art soft close devices have attempted to provide various ways to deactivate hinge dampers, but have done so unsatisfactorily. The prior art suffers from disadvantages such as complicated construction and high manufacturing cost.

For example, U.S. Pat. No. 9,057,214 to Salice discloses a hinge with a deactivatable decelerating device. The device requires a housing slidably engaged with a double barreled slider. A biasing member within the slider has a side projection and a blocking member attached to the housing has a projecting part. The projecting part must extend through a hole in the housing to engage the side projection to deactivate the damping functionality.

U.S. Pat. No. 8,561,262 to Liang, et al. discloses a damping device for a hinge assembly. The device comprises a housing fitted to a hinge cup, a damper slidably engaged with the housing, and an adjustment member movably connected to the housing. The adjustment member includes upper and lower tabs for engagement with the housing, tips and protrusions for engagement with the housing and the damper, a hook for engagement with a spring to bias the adjustment member relative to the housing, and an additional protruded portion for contact with a piston rod extending from the damper.

Hence, there is a need for a soft close device for a compact hinge that is uncomplicated, requires minimal separate parts, and is easy and inexpensive to manufacture.

SUMMARY OF THE DISCLOSURE

A preferred embodiment is comprised of a housing generally shaped to mimic the interior of a hinge cup slidably engaged with a damping plunger. The housing includes a cylindrically shaped cavity sized to receive the plunger. A track connected to the housing leads to the cavity and supports the plunger. The track has a slot sized to receive a collar extending from the plunger to provide the deactivation functionality. The plunger is a damper mechanism comprised of a fluid filled cylinder having an angled face on one end and a piston rod extending from the opposite end. The piston rod extends through the back of the housing and abuts the hinge cup. The piston rod is connected to a piston head which slides within the cylinder to provide the soft close functionality. A helical spring on the piston rod between the cylinder and the housing biases the plunger out of the housing. To deactivate the soft close functionality, the plunger is rotated so that the collar engages the slot. To reactivate the soft close functionality, the plunger is rotated in an opposite direction so that the collar disengages from the slot.

In an alternate embodiment, the collar includes a channel. A tab slides along the collar via the channel. To deactivate the soft close functionality, the tab is moved along the collar via the channel so that the tab engages the slot. To reactivate the soft close functionality, the tab is moved in an opposite direction along the collar via the channel so that the tab disengages from the slot.

An alternate embodiment is comprised of a housing, generally shaped to fit the interior of a hinge cup, slidably engaged with a damping plunger. The housing includes a rectangular shaped cavity sized and shaped to receive the plunger. A track connected to the housing leads to the cavity and supports the plunger. An arm extends from an upper surface of the housing towards the track. A finger shaped distention is formed on the upper surface of the arm. A deactivation catch extends from the lower surface of the arm towards the cavity. The plunger includes a deactivation detent extending from an upper surface aligned with the deactivation catch. The plunger is a damper mechanism which includes a cylindrically shaped, fluid filled cavity. The plunger has an angled face on one end and a piston rod extending from the cavity on the opposite end. The piston rod extends through the back of the housing and abuts the hinge cup. The piston rod is connected to a piston head which slides within the cavity to provide the soft close functionality. A helical spring on the piston rod between the plunger and the housing biases the plunger out of the housing. To deactivate the soft close functionality, the plunger is manually depressed such that the deactivation detent bypasses and engages the deactivation catch. To reactivate the soft close functionality, the arm is deformed upward via the distension such that the deactivation detent bypasses and disengages from the deactivation catch.

Those skilled in the art will appreciate the above-mentioned features and advantages of the disclosure together with other important aspects upon reading the detailed description that follows in conjunction with the drawings.

DETAILED DESCRIPTION

In the description that follows, like parts are marked throughout the specification and figures with the same numerals, respectively. The figures are not necessarily drawn to scale and may be shown in exaggerated or generalized form in the interest of clarity and conciseness.

The apparatus disclosed is a soft close hinge attachment configured to be removably affixed inside the hinge cup of a pre-existing compact hinge. The apparatus is capable of controlling the closing motion of a cabinet door so that the door member will softly close thus prolonging the useful life of the hinge and the cabinetry. The soft close functionality of the apparatus can be easily deactivated. The apparatus is unobtrusive, simple to manufacture, and easily installed and removed.

Figure 1:
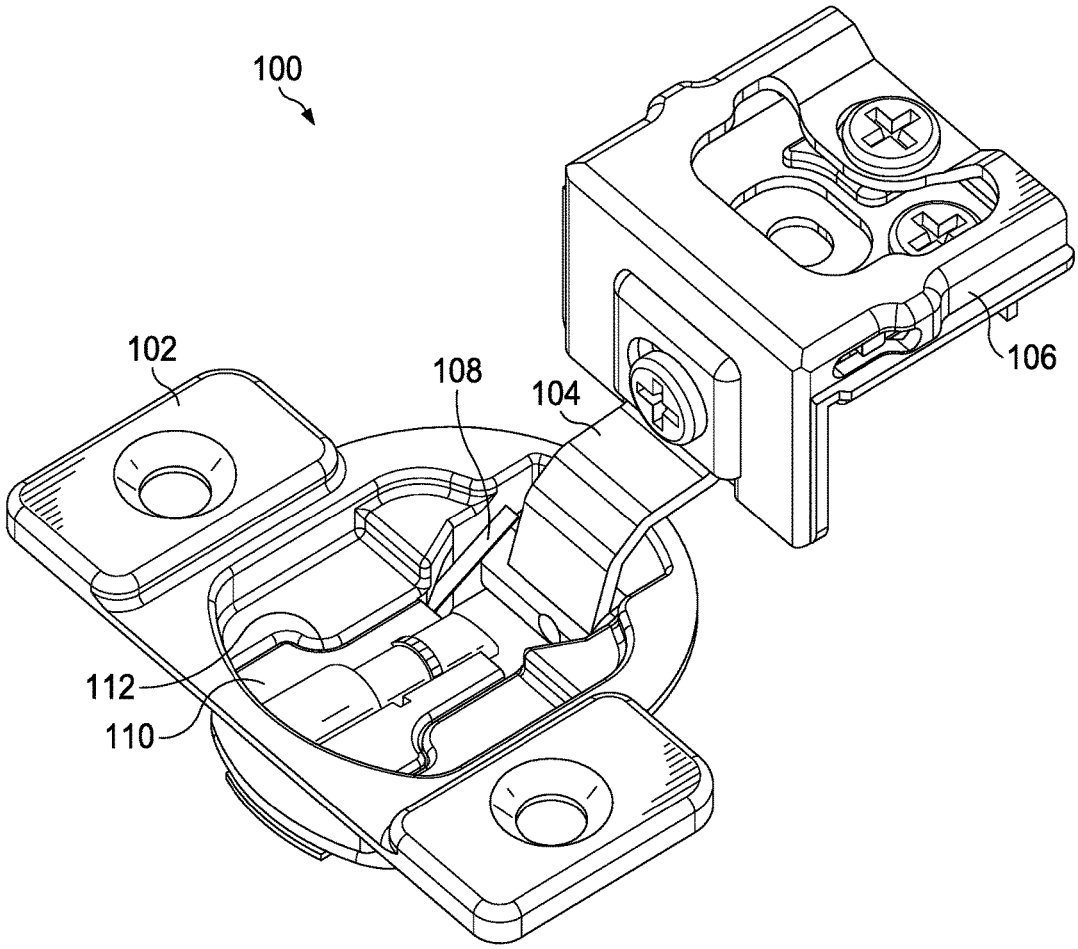
FIG. 1 is an isometric view of a preferred embodiment engaged with a compact hinge.

Referring to FIG. 1, compact hinge 100 provides a pivotal connection between a cabinet door and a cabinet frame. Compact hinge 100 includes hinge cup 102, hinge arm 104, hinge body 106, at least one spring 108, and damping device 110. Hinge cup 102 defines a semi-circular shaped interior 112. Hinge cup 102 is pivotally connected to hinge arm 104. Hinge arm 104 is adjustably connected to hinge body 106. Typically, hinge cup 102 is mounted to the cabinet door and hinge body 106 is mounted to the cabinet frame. It should be noted that the orientation of the hinge cup fitted into a bore opening on a cabinet door and the hinge arm fitted on the cabinet frame could be reversed even though this is not the usual practice. In a preferred embodiment, hinge cup 102, hinge arm 104, and hinge body 106 are constructed of metal such as cast aluminum or steel alloy plate stock and formed by stamping.

Spring 108 and damping device 110 are mounted in interior 112 of hinge cup 102. Spring 108 creates a bias on the hinge arm. During an opening movement in which hinge cup 102 is opened with respect to hinge arm 104, spring 108 provides an opening force. During a closing movement in which hinge cup 102 is closed with respect to hinge arm 104, spring 108 provides a closing force. Damping device 110 is positioned within interior 112 such that damping device 110 abuts hinge arm 104 and creates a damping force that opposes the closing force provide by spring 108 thus providing the soft close functionality.

Figure 2:
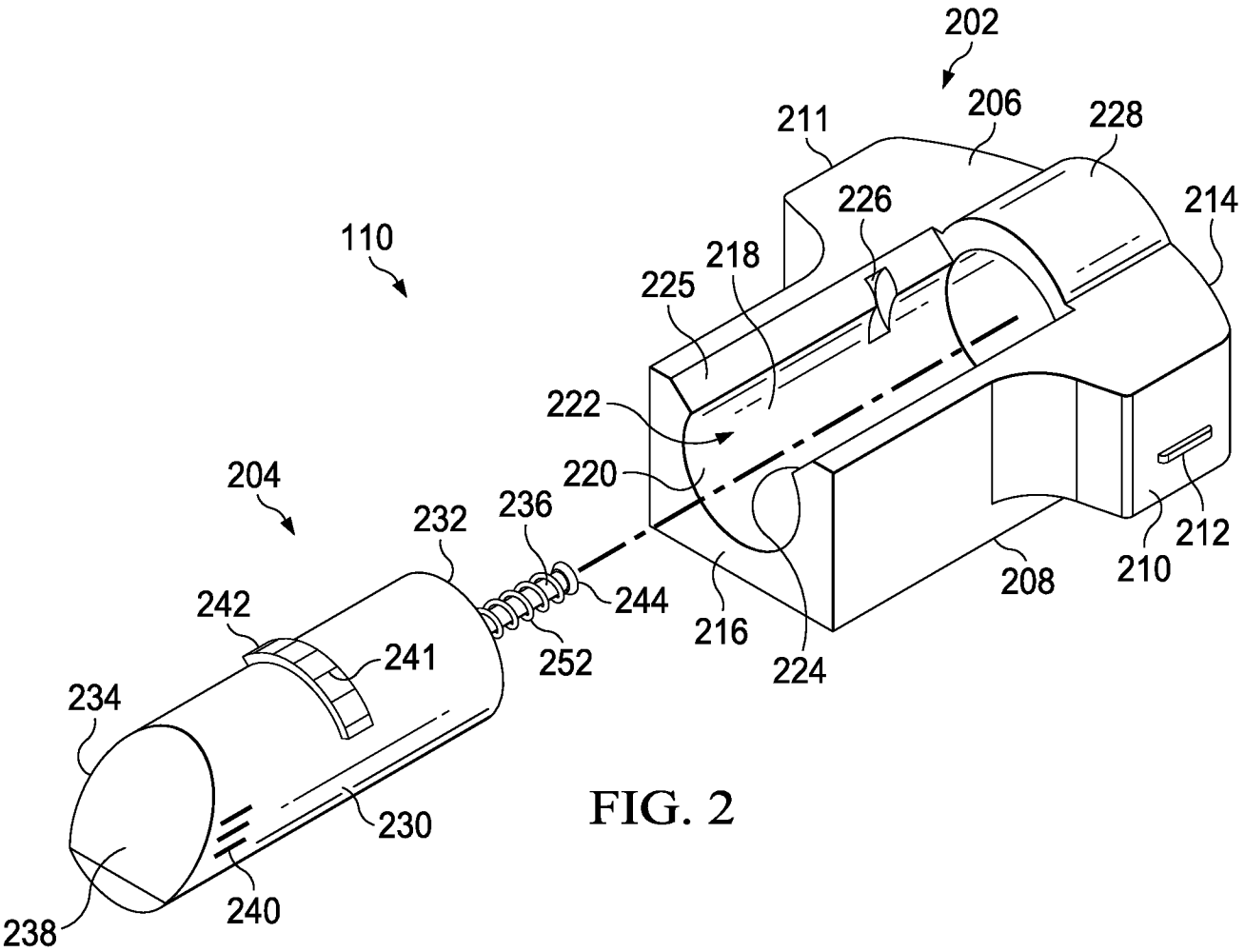
FIG. 2 is an exploded isometric view of a preferred embodiment.
Figure 3A:
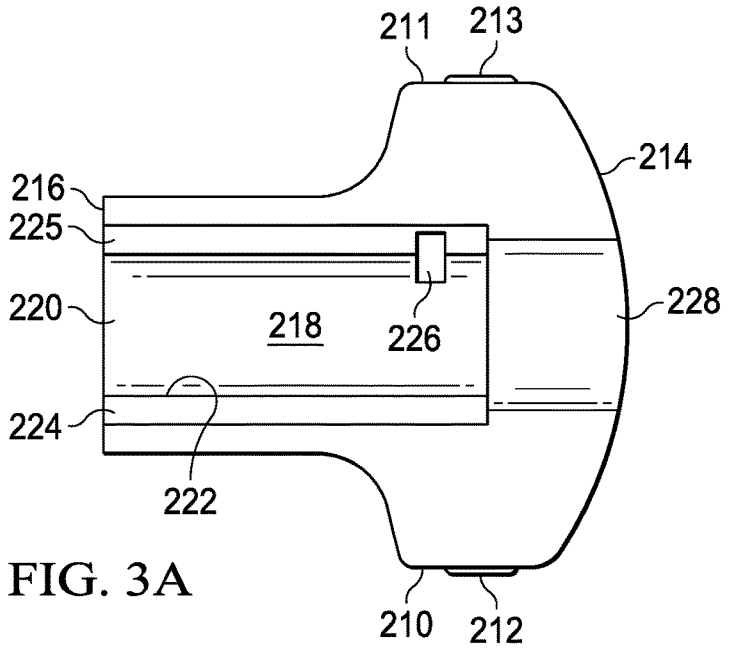
FIG. 3A is a top view of a housing of a preferred embodiment.
Figure 3B:
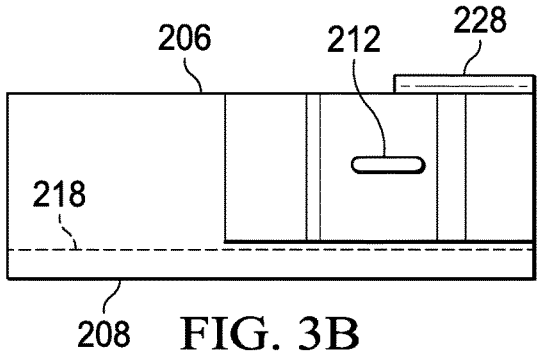
FIG. 3B is a side view of a housing of a preferred embodiment.
Figure 3C:
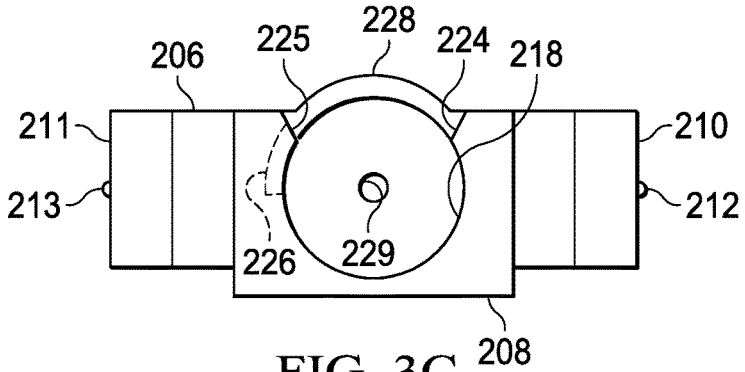
FIG. 3C is an end view of a housing of a preferred embodiment.

Referring to FIG. 2, damping device 110 is comprised of housing 202 slidingly engaged with plunger 204.

As shown in FIGS. 2 and 3A-3C, housing 202 is generally shaped and sized to conform to the shape of interior 112. Housing 202 includes upper surface 206 opposite lower surface 208. Upper surface 206 is generally "T" shaped while lower surface 208 is generally rectangular. When installed in a hinge cup, lower surface 208 is adjacent the base of the hinge cup. Housing 202 further includes sides 210 and 211 extending generally horizontally proximate upper surface 206. Tabs 212 and 213 extend from sides 210 and 211, respectively, allowing for quick installation within and removal from interior 112 of hinge cup 102. In alternate embodiments, tabs 212 and 213 may be latches, holes, adhesive or other known attachment structures used to engage the hinge cup. Positioned between sides 210 and 211, housing 202 includes ends 214 and 216. End 214 is generally shaped to conform to the semi-circular shape of interior 112. End 214 includes hole 229. End 216 opposes end 214. Cylindrically shaped cavity 218 extends between ends 214 and 216. Cavity 218 has open end 220 at end 216. Top surface 206 defines opening 222. Opening 222 leads to cavity 218. Opening 222 has angled edges 224 and 225. Cavity 218 and angled edge 225 include slot 226. Arch 228 extends from upper surface 206 proximate end 214 to secure end 232 of cylinder 230 within housing 202.

Figure 4A:
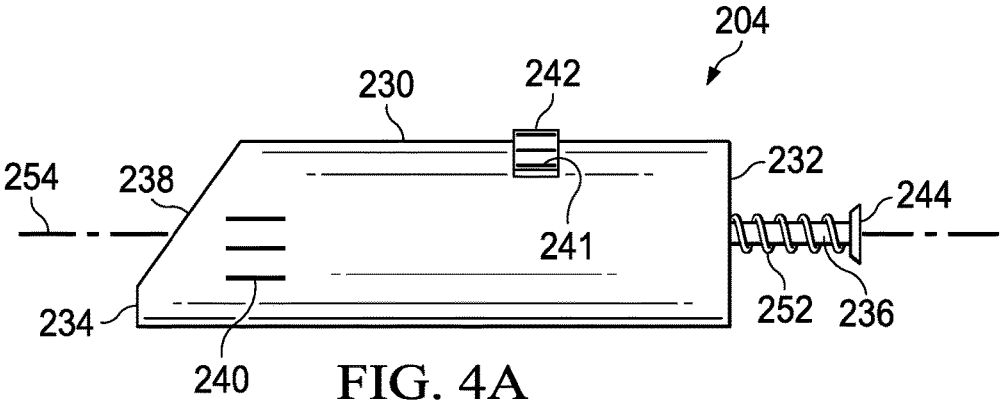
FIG. 4A is a side view of a plunger of a preferred embodiment.
Figure 4B:
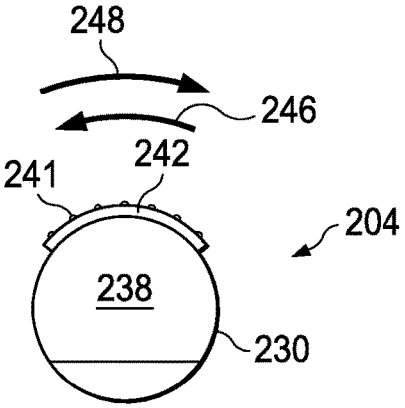
FIG. 4B is an end view of a plunger of a preferred embodiment.

As shown in FIGS. 2 and 4A-B, plunger 204 is generally cylindrically shaped and sized to slidingly engage cavity 218. Plunger 204 is comprised of a fluid filled cylinder 230 having opposing ends 232 and 234. Piston rod 236 extends from end 232 of cylinder 230 and is affixed to end 214 of housing 202 via hole 229. The piston rod includes piston head 250 (shown in FIG. 6) which moves within the fluid filled cylinder 230 to provide the soft close functionality. Opposite piston head 250 on the piston rod is tip 244. Helical spring 252 surrounds an exposed section of piston rod 236 and biases the cylinder out of the housing through open end 220 of cavity 218 into a resting position ready to damp the closing motion of the cabinet door. End 234 includes angled face 238 for contact with the hinge arm. Ridges 240 extend from opposing sides of the exterior of cylinder 230 proximate end 234 providing a non-slip surface. Collar 242 extends from the exterior of cylinder 230 positioned approximately midway between ends 232 and 234. Collar 242 is arc shaped and follows a portion of the circumference of cylinder 230. Collar 242 contacts and slides along angled surfaces 224 and 225. Collar 242 is sized to engage slot 226. Raised ridges 241 extend from collar 242 providing a non-slip surface. Plunger 204 is free to rotate about its central longitudinal axis 254 in directions 246 and 248.

Figure 5A:
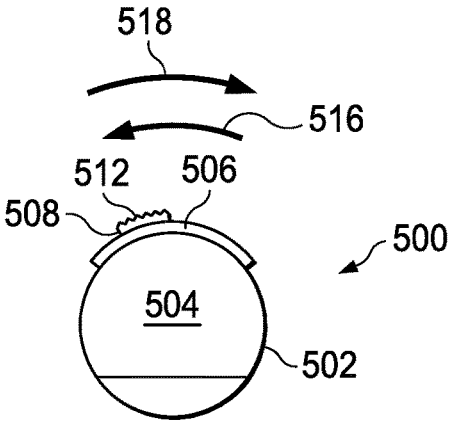
FIG. 5A is an end view of a plunger of an alternate preferred embodiment.
Figure 5B:
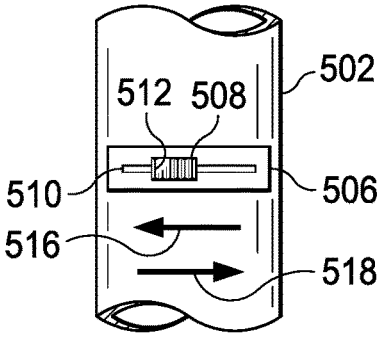
FIG. 5B is partial top view of a plunger of an alternate preferred embodiment.

Referring to FIGS. 5A and 5B, an alternate embodiment, plunger 500, is shown. Plunger 500 is generally cylindrically shaped and sized to slidingly engage cavity 218. Plunger 500 includes cylinder 502 having opposing ends. A piston rod extends from one end and is affixed to end 214 of housing 202 via hole 229. The piston rod includes a piston head which moves within the fluid filled cylinder 502 to provide the soft close functionality. A spring biases the cylinder out of the housing through open end 220 of cavity 218 into a resting position ready to damp the closing motion of the cabinet door. The end opposite the piston rod includes angled face 504 for contact with the hinge arm. Collar 506 extends along a portion of the perimeter of cylinder 502. Collar 506 contacts and slides along angled surfaces 224 and 225. Collar 506 includes slot 510. Tab 508 is slidingly engaged with collar 506 via slot 510. Tab 508 is free to slide along slot 510 in directions 516 and 518. Tab 508 is sized to engage slot 226. Raised ridges 512 extend from tab 508 providing a non-slip surface.

Figure 6:
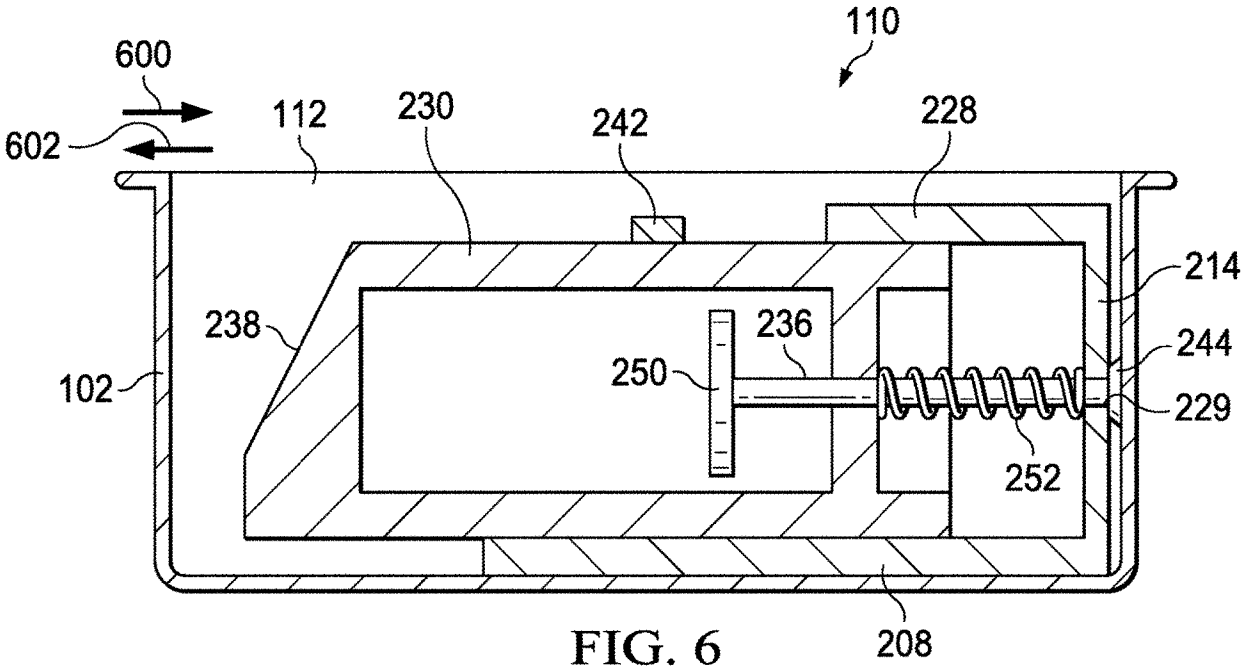
FIG. 6 is a sectional view of a preferred embodiment seated within a hinge cup.

Referring to FIG. 6, damping device 110 is shown seated within hinge cup 102 in a resting position. Lower surface 208 is adjacent the bottom of hinge cup 102. Piston rod 236 extends from cylinder 230 and passes through end 214 via hole 229. Tip 244 abuts hinge cup 102 and prevents piston rod from backing out of hole 229. Angled face 238 is positioned for engagement with the hinge arm upon a closing movement.

In use, damping device 110 is fitted within hinge cup 102 via tabs 212 and 213 engaging side walls of the hinge cup. Damping device 110 is positioned within interior 112 of the hinge cup such that plunger 204 is located within the pivoting path of hinge arm 104. As hinge arm 104 pivots during a closing movement, hinge arm 104 abuts angled face 238 and forces cylinder 230 into housing 202 in direction 600. Cylinder 230 slides toward housing 202 through cavity 218. Piston rod 236 remains stationary as tip 244 abuts hinge cup 102. As cylinder 230 slides in direction 600, piston head 250 moves through the fluid inside cylinder 230 thereby opposing the closing force provided by spring 108 and damping the closing movement of the hinge arm and the attached cabinet door.

To deactivate the soft close functionality of damping device 110, the plunger is manually moved into the housing until collar 242 is aligned with slot 226. Cylinder 230 is rotated in direction 246 such that collar 242 engages slot 226. The engagement of the tab with the slot checks the bias of spring 252 and prevents the cylinder from moving out of the housing to the resting position. Ridges 240 and/or raised ridges 241 provide non-slip contact points to effect the rotation of the cylinder.

To reactivate the damping functionality of damping device 110, cylinder 230 is rotated in direction 248 such that collar 242 is released from engagement with slot 226. Once the tab is no longer engaged with the slot, the bias of spring 252 forces the cylinder out of the housing in direction 602 to the resting position. Angled face 238 automatically realigns the cylinder when it is contacted by the hinge arm.

To deactivate the soft close functionality of damping device 110 having alternate embodiment plunger 500, the plunger is manually moved into the housing until collar 506 is aligned with slot 226. Tab 508 is moved in direction 516 along slot 510 such that tab 508 engages slot 226. The engagement of the tab with the slot checks the bias of spring 252 and prevents the cylinder from moving out of the housing to the resting position. Raised ridges 512 provide a non-slip contact point to effect the movement of the tab.

To reactivate the damping functionality of damping device 110 having alternate embodiment plunger 500, tab 508 is moved in direction 518 along slot 510 such that tab 508 is released from engagement with slot 226. Once the tab is no longer engaged with the slot, the bias of spring 252 forces the cylinder out of the housing to the resting position.

Figure 7:
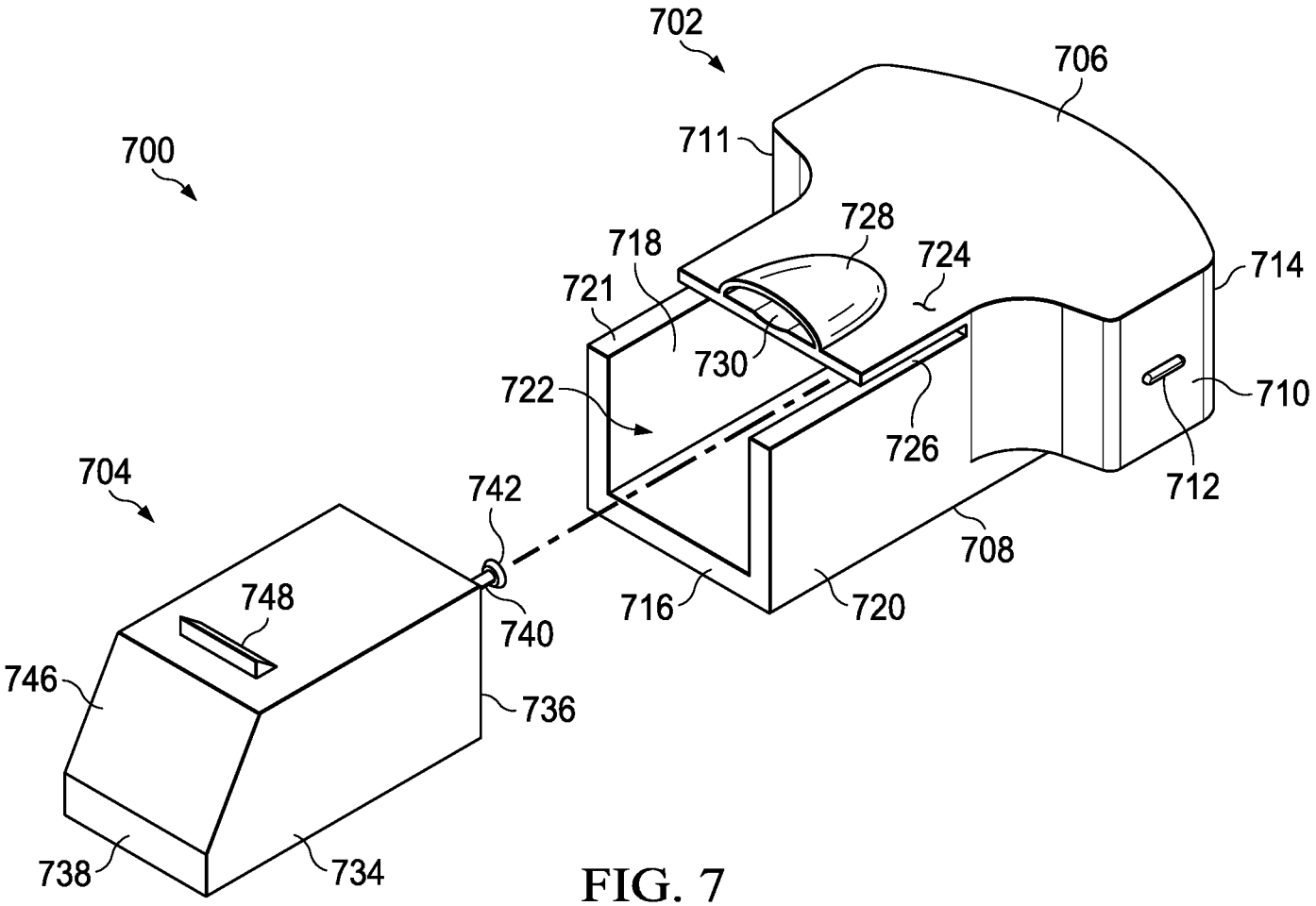
FIG. 7 is an exploded isometric view of an alternate preferred embodiment.
Figure 8A:
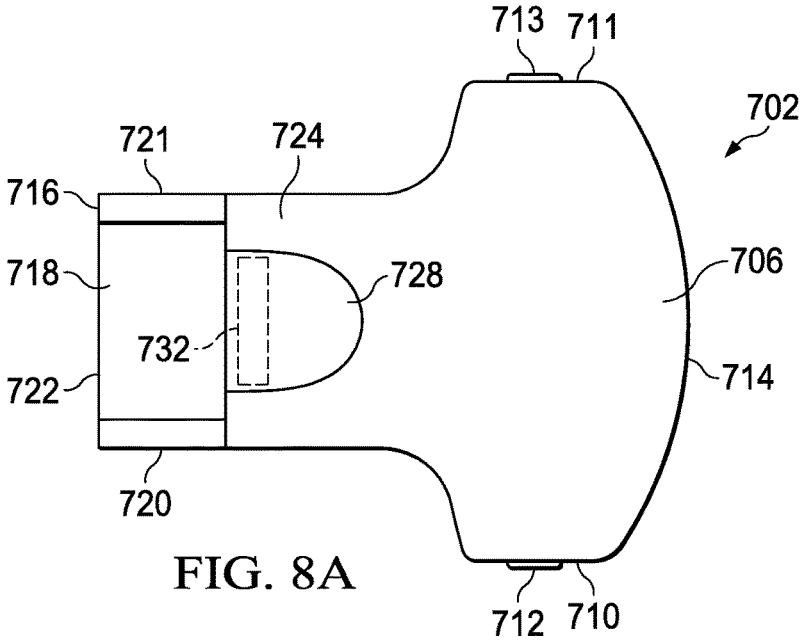
FIG. 8A is a top view of a housing of an alternate preferred embodiment.
Figure 8B:
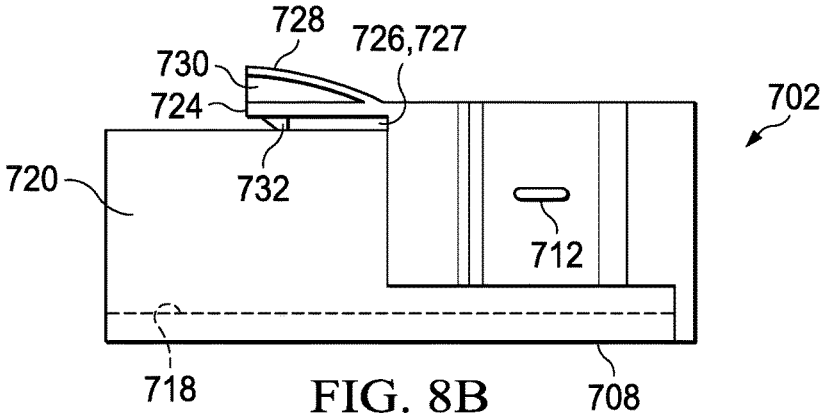
FIG. 8B is a side view of a housing of an alternate preferred embodiment.
Figure 8C:
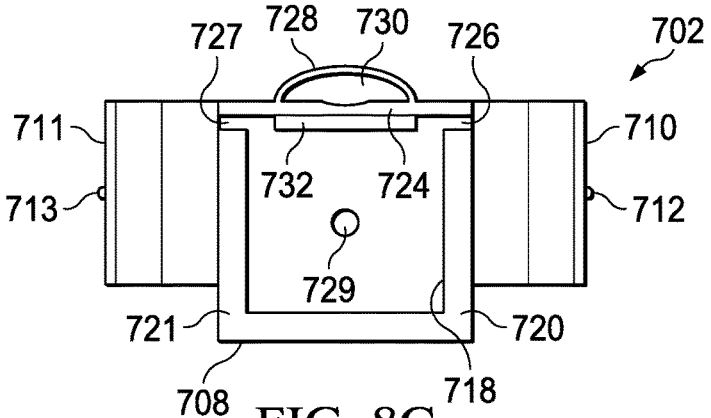
FIG. 8C is an end view of a housing of an alternate preferred embodiment.

Referring to FIG. 7, an alternate embodiment, damping device 700, is shown. Damping device 700 is comprised of housing 702 slidingly engaged with plunger 704.

As shown in FIGS. 7 and 8A-8C, housing 702 is generally shaped and sized to conform to the shape of interior 112. Housing 702 includes upper surface 706 opposite lower surface 708. Upper surface 706 is generally "T" shaped while lower surface 708 is generally rectangular. When installed in a hinge cup, lower surface 708 is adjacent the base of the hinge cup. Housing 702 further includes sides 710 and 711 extending generally horizontally proximate upper surface 706. Tabs 712 and 713 extend from sides 710 and 711, respectively, for installation within and removal from interior 112 of hinge cup 102. In alternate embodiments, tabs 712 and 713 may be latches, holes, adhesive or other known attachment structures used to engage corresponding attachment structures present in the hinge cup. Positioned between sides 710 and 711, housing 702 includes ends 714 and 716. End 714 is generally shaped to conform to the semi-circular shape of interior 112. End 714 includes hole 729. End 716 opposes end 714. Rectangular shaped cavity 718 extends between ends 714 and 716. Cavity 718 is defined by sidewalls 720 and 721 and lower surface 708. Cavity 718 has open end 722 at end 716 between sidewalls 720 and 721. Arm 724 is a continuation of upper surface 706 and extends toward end 716 adjacent sidewalls 720 and 721. Arm 724 is separated from side walls 720 and 721 by slots 726 and 727, respectively. In a resting position, slots 726 and 727 have a generally continuous width. Arm 724 is flexible and can elastically deform such that the width of slots 726 and 727 increase with pressure applied to arm 724. Once pressure is removed from arm 724, slots 726 and 727 return to original continuous width. Arch 728 extends from arm 724 proximate slots 726 and 727. Arch 728 defines opening 730. Catch 732 extends from arm 724 opposite arch 728 toward cavity 718.

Figure 9A:
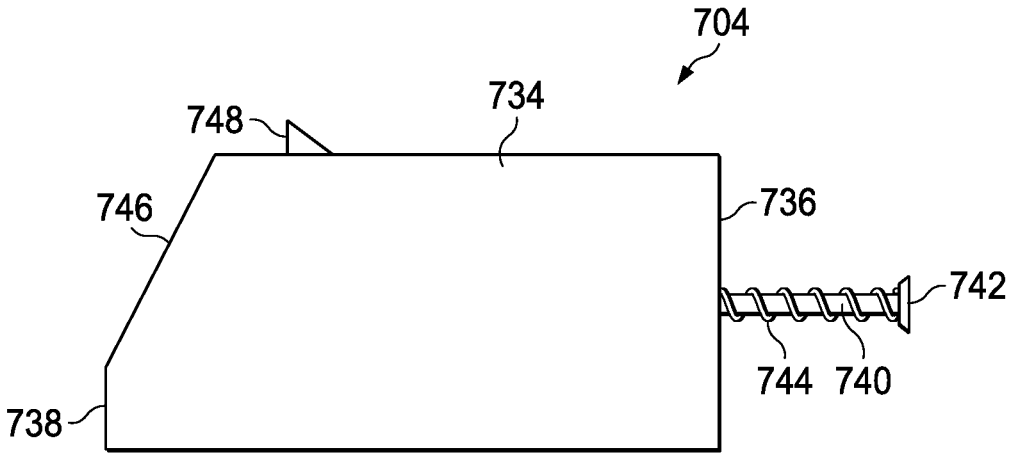
FIG. 9A is a side view of a plunger of an alternate preferred embodiment.
Figure 9B:
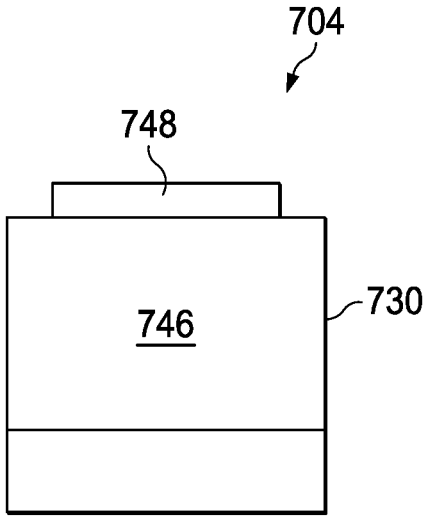
FIG. 9B is an end view of a plunger of an alternate preferred embodiment.

As shown in FIGS. 7 and 9A-B, plunger 704 is generally rectangular shaped and sized to slidingly engage cavity 718. Plunger 704 and cavity 718 have the same cross-sectional shape. In alternate embodiments, cavity 718 and plunger 704 may be any shape that allows slidable engagement between the two. Plunger 704 is comprised of a fluid filled body 734 having opposing ends 736 and 738. Piston rod 740 extends from end 736 of body 734 and is affixed to end 714 of housing 702 via hole 729. The piston rod includes piston head 750 (shown in FIGS. 10A-C) which moves within the fluid filled body 734 to provide the soft close functionality. Opposite piston head 750 on the piston rod is tip 742. Helical spring 744 surrounds an exposed section of piston rod 740 and biases the body out of the housing through open end 722 of cavity 718 into a resting position ready to damp the closing motion of the cabinet door. End 738 includes angled face 746 for contact with the hinge arm. Detent 748 extends from body 734 positioned proximate end 738.

Figure 10A:
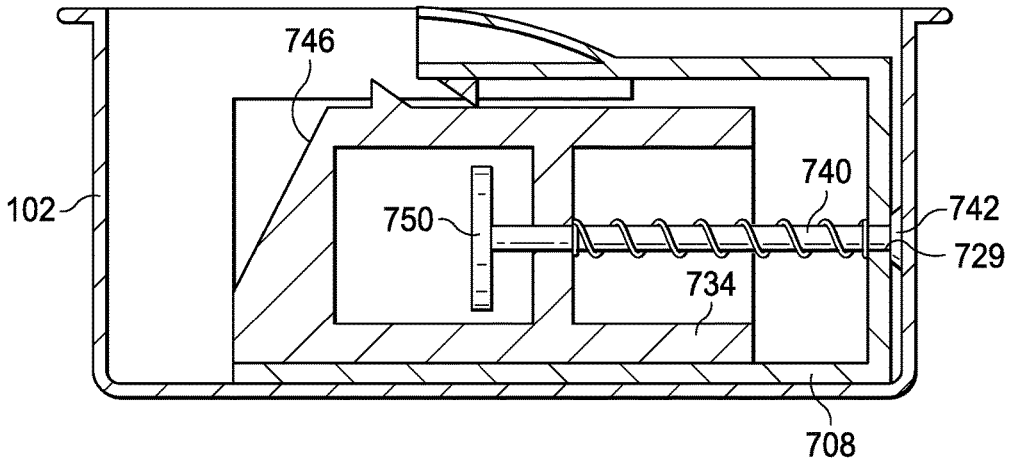
FIG. 10A is a section view of an alternate preferred embodiment in a resting position.

Referring to FIG. 10A, damping device 700 is shown seated within hinge cup 102 in a resting position. Lower surface 708 is adjacent the bottom of hinge cup 102. Piston rod 740 extends from body 734 and passes through end 714 via hole 729. Tip 742 abuts hinge cup 102 and prevents piston rod from backing out of hole 729. Angled face 746 is positioned for engagement with the hinge arm upon a closing movement.

In use, damping device 700 is fitted within hinge cup 102 via tabs 712 and 713 engaging side walls of the hinge cup. Damping device 700 is positioned within interior 112 of the hinge cup such that plunger 704 is located within the pivoting path of hinge arm 104. As hinge arm 104 pivots during a closing movement, hinge arm 104 abuts angled face 746 and forces body 734 into housing 702. Body 734 slides toward housing 702 through cavity 718. Piston rod 740 remains stationary as tip 742 abuts hinge cup 102. As body 734 slides, piston head 750 moves through the fluid inside body 734 thereby opposing the closing force provided by spring 108 and damping the closing movement of the hinge arm and the attached cabinet door. Arm 724 remains generally parallel with body 734.

Figure 10B:
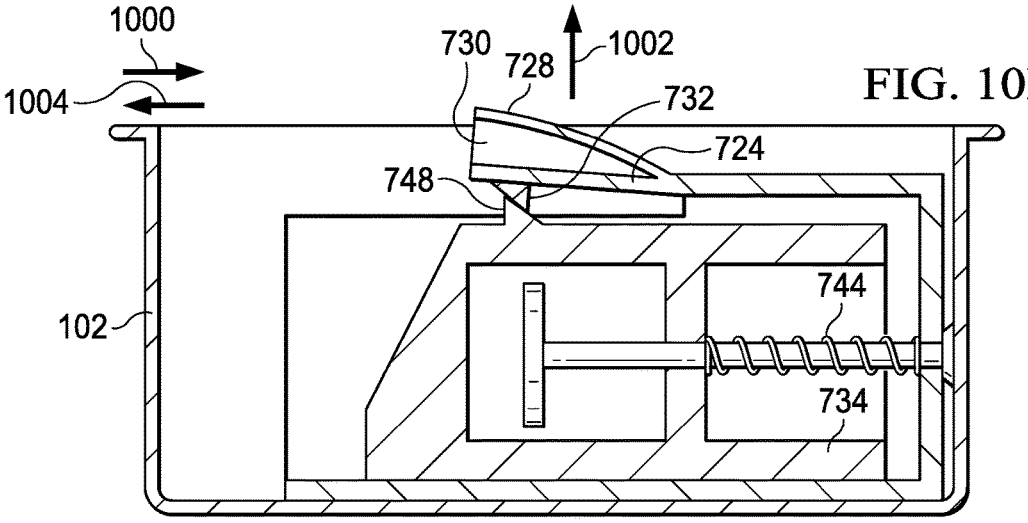
FIG. 10B is a section view an arm of an alternate preferred embodiment resiliently flexed.
Figure 10C:
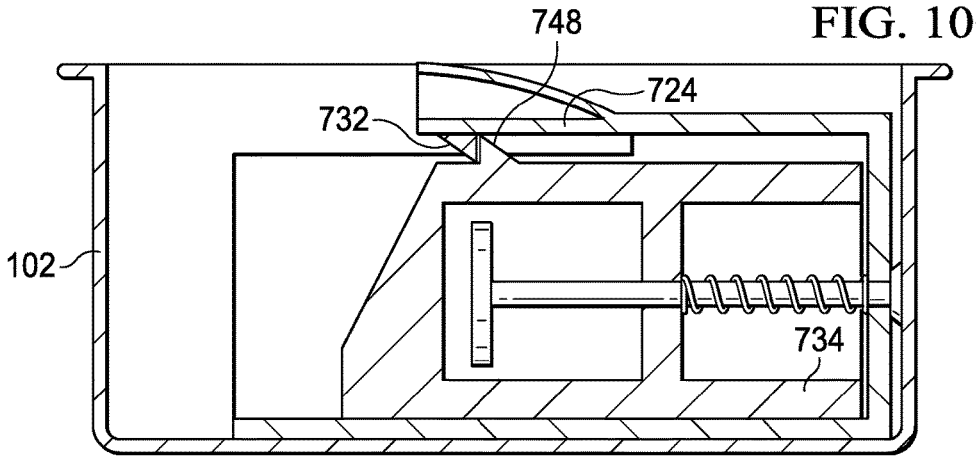
FIG. 10C is a section view of an alternate preferred embodiment in a deactivated position.

As shown in FIGS. 10B and 10C, to deactivate the soft close functionality of damping device 700, the plunger is manually moved into the housing in direction 1000 until detent 748 abuts catch 732. As body 734 continues movement in direction 1000, arm 724 deforms in direction 1002 such that detent 748 bypasses catch 732. Once detent 748 bypasses catch 732, arm 724 resiliently returns to be generally parallel with body 734. Once force to move body 734 in direction 1000 is ceased, detent 748 engages catch 732. The engagement of the detent with the catch checks the bias of spring 744 and prevents the body from moving out of the housing to the resting position.

To reactivate the damping functionality of damping device 700, a force applied to arm 724 in direction 1002 deforms arm 724 such that detent 748 is released from engagement with catch 732. Arch 728 and opening 730 provide an access point for a finger or tool to assist with deforming arm 724. Once the detent is no longer engaged with the catch, the bias of spring 744 forces the cylinder out of the housing in direction 1004 to the resting position. Once the force applied to arm 724 in direction 1002 is removed, arm 724 resiliently returns to be generally parallel with body 734.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A soft-close device for a compact hinge comprising:
- a housing configured to be attached to the compact hinge;
- a plunger slidingly engaged with the housing and configured to abut the compact hinge;
- a detent extending from the plunger;
- a catch extending from the housing for engagement with the detent;
- wherein upon contact with the compact hinge the plunger slides toward the housing and provides a soft-close functionality;
- wherein upon engagement of the detent with the catch, the soft-close functionality is deactivated; and,
- wherein the housing further comprises:
- a cavity spaced between a first sidewall and a second sidewall;
- a flexible arm extending from an upper surface;
- a first slot adjacent the first sidewall and the arm;
- a second slot adjacent the second sidewall and the arm; and,
- an arch extending from the arm adjacent the first slot and the second slot.

2. The soft-close device of claim 1 wherein the housing further comprises:
- a first side extending from an upper surface;
- a second side extending from the upper surface;
- a first attachment means on the first side configured to be attached to the compact hinge; and,
- a second attachment means on the second side configured to be attached to the compact hinge.

3. The soft-close device of claim 1 wherein the housing further comprises:
- the flexible arm adjacent the first sidewall, the second sidewall and the cavity; and,
- whereby deformation of the flexible arm in a direction away from the cavity allows the detent to bypass the catch.

4. The soft-close device of claim 1 wherein the plunger further comprises:
- a fluid filled body for slidable engagement with the housing;
- a piston rod extending from the body and configured to abut the compact hinge;
- a piston head attached to the piston rod for movement through the body; and,
- wherein the detent extends from the body.

5. The soft-close device of claim 1 wherein the plunger further comprises:
- a body, having a first cross-section, for slidable engagement with the cavity formed in the housing, where the cavity has the first cross-section; and,
- an angled face on the body configured to abut the compact hinge.

6. The soft-close device of claim 1 wherein the plunger further comprises:
- a fluid filled body for slidable engagement with the housing;
- a piston rod extending from the body and configured to abut the compact hinge;
- a spring, surrounding the piston rod, adjacent the body and the housing; and,
- the spring biasing the body away from the housing.

7. A method of deactivating the soft-close functionality of a soft close device having a housing slidingly engaged with a plunger, a first part defined in the housing, and a second part extending from the plunger comprising:
- providing the housing configured to be attached to the compact hinge;
- wherein the housing is provided to include:
  - a cavity spaced between a first sidewall and a second sidewall;
  - a flexible arm extending from an upper surface;
  - a first slot adjacent the first sidewall and the arm;
  - a second slot adjacent the second sidewall and the arm; and,
  - an arch extending from the arm adjacent the first slot and the second slot
- providing a plunger slidingly engaged with the housing and configured to abut the compact hinge;
- providing the second part, including a detent extending from the plunger;
- providing the first part, including a catch extending from the housing for engagement with the detent;
- contacting the plunger with the compact hinge;
- sliding the plunger toward the housing until the first part is adjacent the second part;
- engaging the first part with the second part; and,
- whereby the soft-close functionality of the device is deactivated.

8. The method of claim 7 wherein the first part extends from a flexible arm formed in the housing, further comprising:
- deforming the flexible arm away from the plunger; and,
- sliding the plunger away from the housing until the second part bypasses the first part.

* * * * *